US006887320B2

(12) United States Patent
Briles et al.

(10) Patent No.: US 6,887,320 B2
(45) Date of Patent: May 3, 2005

(54) CORROSION RESISTANT, CHROMATE-FREE CONVERSION COATING FOR MAGNESIUM ALLOYS

(75) Inventors: Owen M. Briles, Rockford, IL (US); Mark Jaworowski, Glastonbury, CT (US); Michael A. Kryzman, West Hartford, CT (US)

(73) Assignees: United Technologies Corporation, Hartford, CT (US); Hamilton Sundstrand Corporation, Windsor Locks, CT (US)

( * ) Notice: Subject to any disclaimer, the term of this patent is extended or adjusted under 35 U.S.C. 154(b) by 373 days.

(21) Appl. No.: 10/073,688

(22) Filed: Feb. 11, 2002

(65) Prior Publication Data

US 2003/0150525 A1 Aug. 14, 2003

(51) Int. Cl.[7] ..... C23C 22/07

(52) U.S. Cl. ..... 148/253; 148/261; 148/275; 106/14.12; 252/389.54

(58) Field of Search ..... 148/243, 253, 148/261, 275; 106/14.12; 252/389.54

(56) References Cited

U.S. PATENT DOCUMENTS 5,520,750 A * 5/1996 Riley ..... 148/261

5,683,522 A 11/1997 Joesten

FOREIGN PATENT DOCUMENTS

JP 2001123274 A * 5/2001 ..... C23C/22/18

* cited by examiner

*Primary Examiner*—Roy King
*Assistant Examiner*—Lois Zhang
(74) *Attorney, Agent, or Firm*—Bachman & LaPointe, P.C.

(57) ABSTRACT

The present invention relates to a process for forming a chromate-free, corrosion resistant coating on a product formed from magnesium or a magnesium alloy and to a solution used for forming the coating. The solution has phosphate and fluoride ions and contains from 1.0 g/l to 5.0 g/l of an active corrosion inhibitor selected from the group consisting potassium permanganate, sodium tungstate, sodium vanadate, and mixtures thereof. The solution may also containing from 0.1 to 1.0 vol % of a surfactant which reduces reaction time. The solution is maintained at a temperature of 120 to 200 degrees Fahrenheit and has a pH of 5 to 7. The process for forming the coating broadly comprises degreasing the magnesium or magnesium alloy product in a degreasing solution, cleaning the product in a highly alkaline cleaning solution, deoxidizing the product in a deoxidizing solution, and immersing the product in the coating solution for a time period of 15 minutes to 90 minutes.

20 Claims, 1 Drawing Sheet

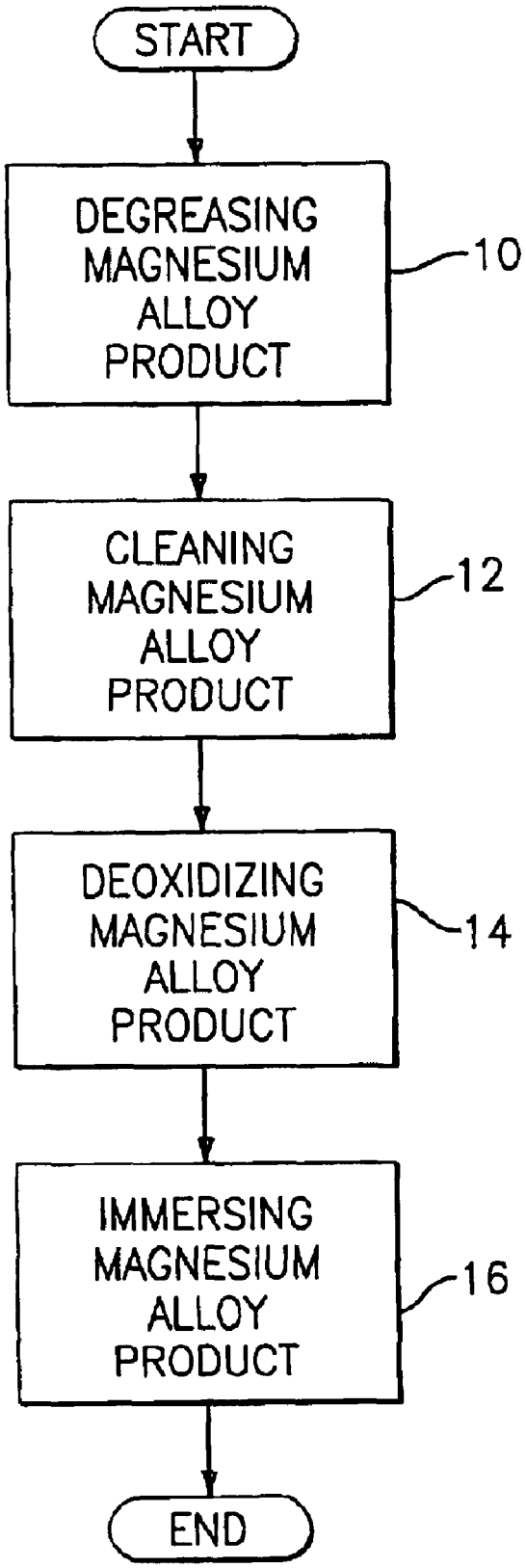
START
DEGREASING MAGNESIUM ALLOY PRODUCT
10
CLEANING MAGNESIUM ALLOY PRODUCT
12
DEOXIDIZING MAGNESIUM ALLOY PRODUCT
14
IMMERSING MAGNESIUM ALLOY PRODUCT
16
END

CORROSION RESISTANT, CHROMATE-FREE CONVERSION COATING FOR MAGNESIUM ALLOYS

BACKGROUND OF THE INVENTION

The present invention relates to a process for applying a corrosion resistant, chromate-free conversion coating to a product formed from magnesium or a magnesium alloy and to a coating solution used in the process.

Magnesium alloys are light and strong, but very vulnerable to corrosion due to the reactive nature of magnesium. Magnesium alloys are protected from corrosion in all practical applications. A commonly used, low cost, corrosion resistant treatment for magnesium alloys is a dichromate based conversion coating. While dichromate based conversion coatings provide good corrosion protection, they are based on a chemical compound (hexavalent chromium) that has many occupational exposure risks. A non-chromated, corrosion resistant magnesium conversion coating is required to meet industry demands.

Another treatment for protecting magnesium or magnesium alloy products is shown in U.S. Pat. No. 5,683,522 to Joesten, which is hereby incorporated by reference herein. In this treatment, a paint adherent and corrosion resistant coating of magnesium phosphate and magnesium fluoride is applied to a product formed from a magnesium alloy. The process for applying the coating involves immersing the magnesium alloy product in a solution having phosphate and fluoride ions. This treatment while providing a barrier film and very good paint adhesion, does not include electrochemically active ingredients to suppress corrosion.

SUMMARY OF THE INVENTION

Accordingly, it is an object of the present invention to provide a process for forming an improved chromate-free corrosion resistant conversion coating for magnesium and magnesium alloy products.

It is a further object of the present invention to provide a coating solution for forming the chromate-free corrosion resistant coating.

The foregoing objects are attained by the present invention.

In accordance with the present invention, a process for applying a chromate free, corrosion resistant conversion coating to a product formed from magnesium or a magnesium alloy broadly comprises the steps of degreasing the product in an aqueous degreasing solution, cleaning the product in a highly alkaline cleaning solution, deoxidizing the product in a deoxidizing solution, and immersing the product in a solution containing phosphate and fluoride ions where a pH level of the solution is controlled in an approximate range of 5 to 7, the solution being provided with 1.0 g/l to 5.0 g/l of an active corrosion inhibitor and being maintained at a temperature of approximately 120 to 200 degrees Fahrenheit while immersing the product for a time period in the range of 15 to 90 minutes.

The solution used to form the chromate-free, corrosion resistant coating on a magnesium or magnesium alloy product comprises the solution having phosphate and fluoride ions, and containing from 1.0 g/l to 5.0 g/l of an active corrosion inhibitor. As mentioned above, the solution has a pH of 5 to 7. The solution may contain 0.01 to 1.0 vol % of a surfactant which reduces the reaction time.

Other details of the magnesium alloy conversion coating of the present invention and of the process for applying same, as well as objects and advantages attendant thereto, are set forth in the following detailed description and the accompanying drawing wherein like reference numerals depict like elements.

BRIEF DESCRIPTION OF THE DRAWING

The FIGURE is a process flow diagram of an embodiment of the instant invention illustrating a non-electrolytic process for applying a chromate free, corrosion resistant conversion coating to a product formed from magnesium or a magnesium alloy.

DETAILED DESCRIPTION OF THE PREFERRED EMBODIMENT(S)

The FIGURE illustrates a process flow diagram for a non-electrolytic process for applying a chromate-free, corrosion resistant coating to a product formed from magnesium or a magnesium alloy. In the aircraft industry, for example, the magnesium alloy product may include any number of operational components such as a generator housings or gearbox components.

The non-electrolytic process may begin with an initial step 10 of degreasing the magnesium alloy product in a degreasing solution. An aqueous-based solution, such as that commonly known and sold in the industry under the trademark OAKITE SC 225, may be used to serve the function of degreasing the magnesium product. This initial step 10 allows for removal of oils and other contaminants on the surface of the magnesium which can subsequently prevent wetting of the surface of a housing, and inhibit the chemical reaction if not removed. One skilled in the art can appreciate that other organic solvents, such as that known in the industry and sold under the label, Blue Gold Industrial Cleaner which is manufactured by Carroll Company, or halogenated solvents such as N-propyl bromide may also serve the degreasing function.

In addition to the degreasing step 10, the non-electrolytic process may include cleaning the magnesium alloy product in a highly alkaline aqueous-based cleaning solution in a cleaning step 12. An example of a highly alkaline cleaner which may be utilized in the cleaning step 12 is known and sold in the industry under the trademark TURCO ALKALINE RUST REMOVER, and manufactured by Turco Products, Inc. Preferably, during the cleaning step 12, the alkaline bath of cleaning solution is continuously agitated while in use, and maintained at a temperature in a range of approximately 180–200 degrees Fahrenheit. In addition, in order to achieve an optimum cleaning effect, the concentration of the cleaning solution may be provided at approximately 20–30 ounces of highly alkaline cleaner per gallon of cleaning solution, with the cleaning solution having a pH of at least 11. By controlling the variables of concentration and pH of the cleaning solution, a preferable cleaning effect may be achieved while immersing the magnesium alloy product in the cleaning solution for a period of approximately 3–5 minutes. The cleaning step 12 further removes impurities from the surface of the magnesium alloy product which could inhibit the chemical reaction necessary to form the conversion coating of the instant invention.

The non-electrolytic process of the instant invention may further include a deoxidizing step 14 which includes deoxidizing the magnesium alloy product in a deoxidizing solution. One solution for effectively deoxidizing may be formulated from sodium acid fluoride, with a concentration of the deoxidizing solution being provided at approximately 3.5–7.0 ounces of sodium acid fluoride per gallon of deoxidizing solution, and a temperature of the solution being maintained at approximately 70–90 degrees Fahrenheit. Preferably, the deoxidizing solution is not agitated while deoxidizing the magnesium alloy product for an optimum period of time of approximately 3–5 minutes. The deoxidizing step 14 effectively removes any metal oxides which are present on the surface of the magnesium alloy housing and which inhibit the chemical reaction of the phosphate conversion coating from occurring.

One skilled in the art can appreciate other solutions, with properties comparable to those disclosed, may accomplish the initial, cleaning, and deoxidizing steps 10, 12, and 14, respectively. For example, the deoxidizing solution of the deoxidizing step 14 may include a solution of nitric acid and hydrofluoric acid. However, because hydrofluoric acid combined with nitric acid is such a strong reactant, its application may be limited when personnel safety is at issue, or when dimensions of the magnesium alloy product are critical to maintain tight tolerances, as a combination of hydrofluoric/nitric acid reacts very strongly on magnesium and may attack the actual surface of the magnesium product.

The non-electrolytic process of the instant invention further includes an immersing step 16. The immersing step 16 involves immersing the magnesium alloy product in a solution having phosphate and fluoride ions. As both phosphate and fluoride ions are negatively-charged anions, each attract positively-charged cations of magnesium which permeate the surface of the housing. The phosphate and fluoride ions react with the magnesium ions to form a conversion coating of magnesium phosphate ($Mg_3(PO_4)_2$) and magnesium fluoride ($MgF_2$) on the surface of the magnesium alloy housing.

Preferably, the immersing step 16 includes controlling a pH level of the solution in a range of 5 to 7. By controlling the pH level of the immersing or coating solution, the phosphate ions will react with the magnesium alloy surface to form a coating which includes magnesium phosphate, as a certain amount of acidity is needed for phosphate to react with magnesium. If indeed the pH of the solution is kept at an alkaline (high) level, little, if any, reaction will occur with the magnesium alloy product to form a conversion coating. If the pH of the solution is kept too low, at an acidic level, the phosphate will massively attack the magnesium alloy and instigate corrosion before a coating has had a chance to form on the surface. Also, if the pH level is kept too low, a coating may form which is excessively high in fluoride content via magnesium fluoride. Such a coating will have poor adhesion qualities for an organic coating.

One skilled in the art may readily appreciate a controlled pH may be provided through a phosphate compound such as monobasic potassium phosphate ($KH_2PO_4$), dibasic potassium phosphate ($K_2HPO_4$), tribasic potassium phosphate ($K_3PO_4$), or phosphoric acid ($H_3PO_4$), or combinations of these alternatives. A preferred embodiment to achieve the desired immersing solution pH level of the instant invention includes combining monobasic potassium phosphate, at a nominal concentration by weight of approximately 1.8 ounces per gallon of solution, with dibasic potassium phosphate, at a nominal concentration by weight of approximately 3.6 ounces per gallon of solution. This combination allows the preferred pH level of the immersing solution to be controlled in an optimum slightly acidic range.

In addition to a controlled pH, the solution of the immersing step 16 is also provided with an optimum amount of fluoride ions in the solution which will adequately react with the surface of the magnesium alloy housing to form a coating of magnesium fluoride. Preferably, the amount of fluoride ions is measured in terms of a concentration by weight of sodium bifluoride ($NaHF_2$). In a preferred embodiment, the concentration is provided at about 0.3–0.5% by weight sodium bifluoride; this range of concentrations may be achieved by using a nominal concentration by weight of sodium bifluoride of about 0.4–0.7 ounces per gallon of solution, respectively. This controlled concentration of fluoride via sodium bifluoride allows a magnesium fluoride conversion coating to form on the surface of the magnesium alloy product on which paint will adequately adhere. If a solution is used which has too high of a fluoride component, poor paint adhesion characteristics will result on the surface of the magnesium.

One skilled in the art may appreciate, other fluoride compounds, such as potassium fluoride or hydrofluoric acid, may be used to introduce fluoride ions into the immersing solution, and conversions may be used to equate such a fluoride compound concentration to an equivalent concentration level measured in terms of sodium bifluoride.

In addition to the above constituents, an active corrosion inhibitor is added to the bath in a concentration of from about 1.0 g/l to 5.0 g/l. The active corrosion inhibitor is preferably selected from the group consisting of potassium permanganate, sodium tungstate, sodium vanadate and mixtures thereof. The addition of sodium vanadate is a preferred choice because it improves the humidity resistance of the conversion coating over a robuts range of concentrations and enables use of a 50% shorter coating cycle. Sodium vanadate when selected may be added to the bath in a concentration of 1.0 g/l to 5.0 g/l, preferably from 2.0 g/l to 5.0 g/l.

Sodium tungstate when selected preferably is present in a concentration from 1.0 g/l to 2.0 g/l, although it may be present in a concentration up to 5.0 g/l. Potassium permanganate when selected is preferably present in a concentration of from 1.0 g/l to 2.0 g/l, although it may be present in a concentration up to 5.0 g/l.

A further improvement can be achieved with the addition of from 0.1 to 1.0 vol % of a surfactant, which reduces the process time to 20 minutes or less. Products such as Union Carbide TRITON X-100 and 3M FC-135 may be used. TRITON X-100 may be used in a concentration of 0.25 to 1.0 vol %. FC-135 may be used at concentrations of 0.01 to 0.10 vol %. TRITON X-100 is a preferred surfactant for the solution of the present invention.

In a preferred embodiment of the immersing step 16, it is extremely advantageous to maintain the solution at a temperature of approximately 130 degrees Fahrenheit, while the magnesium alloy product is immersed in the solution for a period of twenty to thirty minutes. However, one skilled in the art can appreciate that the desired effect of a conversion coating may be achieved within a range of optimal temperatures (i.e. 120–200 degrees Fahrenheit) over a range of periods of minutes (i.e. 15–90 minutes, preferably 25–90 minutes), depending on the desired production time.

By following the steps 10, 12, 14, and 16 in accordance with the disclosed process, one skilled in the art may readily apply a magnesium phosphate and magnesium fluoride coating to a magnesium alloy product which is corrosion resistant and chromate free.

It is not necessary to remove a phosphate/fluoride-based conversion coating which has been applied in accordance with the disclosed invention before applying an additional phosphate/fluoride-based conversion coating in accordance with the disclosed steps 10, 12, 14, and 16. With either environment, under high magnification of a scanning electron microscope, no defects or irregularities should appear in the coating, if steps 10, 12, 14, and 16 have been followed properly, and the coating should possess a porous, bead-like structure.

It is apparent that there has been provided in accordance with the present invention a chromate free, corrosion resistant conversion coating for magnesium and magnesium alloy products which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A process for applying a chromate-free, corrosion resistant coating to a product formed from a magnesium based material, comprising the steps of:

degreasing the product formed from the magnesium based material in a degreasing solution;

cleaning the product formed from the magnesium based material in a highly alkaline cleaning solution;

deoxidizing the product formed from the magnesium based material in a deoxidizing solution; and immersing the product formed from the magnesium based material in a solution containing phosphate and fluoride ions where a pH level of the solution is controlled in an approximate range of 5 to 7, the solution being provided with 1.0 g/l to 5.0 g/l of an active corrosion inhibitor selected from the group consisting of sodium tungstate, sodium vanadate, and mixtures thereof and being maintained at a temperature of approximately 120 to 200 degrees Fahrenheit while immersing the product formed from the magnesium based material for a period of approximately 15 minutes to 90 minutes.

2. A process according to claim 1, wherein said active corrosion inhibitor comprises from 1.0 g/l to 5.0 g/l sodium vanadate.

3. A process according to claim 1, wherein said active corrosion inhibitor comprises from 2.0 g/l to 5.0 g/l sodium vanadate.

4. A process according to claim 1, wherein said active corrosion inhibitor comprises from 1.0 g/l to 2.0 g/l sodium tungstate.

5. A process for applying a chromate-free, corrosion resistant coating to a product formed from a magnesium based material, comprising the steps of:

degreasing the product formed from the magnesium based material in a degreasing solution;

cleaning the product formed from the magnesium based material in a highly alkaline cleaning solution;

deoxidizing the product formed from the magnesium based material in a deoxidizing solution; and immersing the product formed from the magnesium based material in a solution containing phosphate and fluoride ions where a pH level of the solution is controlled in an approximate range of 5 to 7, the solution being provided with from 1.0 g/l to less than 2.0 g/l potassium permanganate and being maintained at a temperature of approximately 120 to 200 degrees Fahrenheit while immersing the product formed from the magnesium based material for a period of approximately 15 minutes to 90 minutes.

6. A process according to claim 1, wherein said solution is provided with from about 03 to 0.5 wt % sodium bifluoride.

7. A process for applying a chromate-free, corrosion resistant coating to a product formed from a magnesium based material, comprising the steps of:

degreasing the product formed from the magnesium based material in a degreasing solution;

cleaning the product formed from the magnesium based material in a highly alkaline cleaning solution;

deoxidizing the product formed from the magnesium based material in a deoxidizing solution; and immersing the product formed from the magnesium based material in a solution containing phosphate and fluoride ions where a pH level of the solution is controlled in an approximate range of 5 to 7, the solution being provided with from 1.0 g/l to 5.0 g/l of an active corrosion inhibitor and being maintained at a temperature of approximately 120 to 200 degrees Fahrenheit while immersing the product formed from the magnesium based material for a period of approximately 15 minutes to 90 minutes; and said phosphate and fluoride containing solution further containing 0.01 to 1.0 vol % of a surfactant.

8. A process according to claim 1, wherein said magnesium based material comprises a magnesium alloy.

9. A non-electrolytic process for applying a chromate free, corrosion resistant coating of at least magnesium phosphate and magnesium fluoride to a product formed from a magnesium alloy, comprising the steps of:

degreasing the product formed from the magnesium alloy in a degreasing solution;

cleaning the product formed from the magnesium alloy in a highly alkaline cleaning solution;

deoxidizing the product formed from the magnesium alloy in a deoxidizing solution;

providing a solution containing phosphate and fluoride ions, from about 0.3 to 0.5 wt % sodium bifluoride, and from about 1.0 g/l to 5.0 g/l of an active corrosion inhibitor selected from the group consisting of sodium tungstate, sodium vanadate, and mixtures thereof, and having a pH level in the range of 5 to 7;

maintaining said solution at a temperature of approximately 120 to 200 degrees Fahrenheit; and immersing said product formed from said magnesium alloy in said solution for a time period in the range of 15 minutes to 90 minutes.

10. A process for applying a chromate free, corrosion resistant coating of at least magnesium phosphate and magnesium fluoride to a product formed from a magnesium alloy, comprising the steps of:

degreasing the product formed from the magnesium alloy in a degreasing solution;

cleaning the product formed from the magnesium alloy in a highly alkaline cleaning solution;

deoxidizing the product formed from the magnesium alloy in a deoxidizing solution;

providing a solution containing phosphate and fluoride ions, from about 0.3 to 0.5 wt % sodium bifluoride, and from about 1.0 g/l to 5.0 g/l of an active corrosion inhibitor selected from the group consisting of potassium permanganate, sodium tungstate, sodium vanadate, and mixtures thereof, and having a pH level in the range of 5 to 7;

maintaining said solution at a temperature of approximately 120 to 200 degrees Fahrenheit;

immersing said product formed from said magnesium alloy in said solution for a time period in the range of 15 minutes to 90 minutes; and said phosphate and fluoride containing solution further containing 0.01 to 1.0 vol % of a surfactant.

11. A non-electrolytic process for applying a chromate free, corrosion resistant coating of at least magnesium phosphate to a product formed from a magnesium alloy, comprising the steps of:

degreasing the magnesium alloy product in a degreasing solution;

cleaning the magnesium alloy product in a highly alkaline cleaning solution;

deoxidizing the magnesium alloy product in a deoxidizing solution;

providing a coating solution containing phosphate and fluoride ions and being provided with a concentration of sodium bifluoride in a range of 0.3 to 0.5 wt % and a concentration of an active corrosion inhibitor selected from the group consisting of sodium tungstate, sodium vanadate, and mixtures thereof in a concentration of from 1.0 g/l to 5.0 g/l;

maintaining the coating solution at a temperature of 120 to 200 degrees Fahrenheit; and immersing the magnesium alloy product in the coating solution for a time period in the range of 15 minutes to 90 minutes.

12. A process for applying a chromate free, corrosion resistant coating of at least magnesium phosphate to a product formed from a magnesium alloy, comprising the steps of:

degreasing the magnesium alloy product in a degreasing solution;

cleaning the magnesium alloy product in a highly alkaline cleaning solution;

deoxidizing the magnesium alloy product in a deoxidizing solution;

providing a coating solution containing phosphate and fluoride ions and being provided with a concentration of sodium bifluoride in a range of 0.3 to 0.5 wt % and a concentration of an active corrosion inhibitor selected from the group consisting of potassium permanganate, sodium tungstate, sodium vanadate, and mixtures thereof in a concentration of from 1.0 g/l to 5.0 g/l;

maintaining the coating solution at a temperature of 120 to 200 degrees Fahrenheit;

immersing the magnesium alloy product in the coating solution for a time period in the range of 15 minutes to 90 minutes; and said phosphate and fluoride containing solution further containing 0.01 to 1.0 vol % of a surfactant.

13. A solution for use in a process for forming a chromate-free, corrosion resistant coating on a product formed from magnesium or a magnesium alloy, comprising:

said solution having phosphate and fluoride ions;

said solution containing from 1.0 g/l to 5.0 g/l of an active corrosion inhibitor selected from the group consisting of sodium tungstate, sodium vanadate, and mixtures thereof; and said solution having a pH of 5 to 7.

14. A solution according to claim 13, wherein said solution further contains about 1.8 ounces per gallon of monobasic potassium phosphate and about 3.6 ounces per gallon of dibasic potassium phosphate.

15. A solution according to claim 13, further containing from 0.3 to 0.5 wt % sodium bifluoride.

16. A solution according to claim 13, wherein said active corrosion inhibitor comprises from 2.0 g/l to 5.0 g/l sodium vanadate.

17. A solution according to claim 13, wherein said active corrosion inhibitor comprises from 1.0 g/l to 2.0 g/l sodium tungstate.

18. A solution for use in a process for forming a chromate-free corrosion resistant coating on a product formed from magnesium or a magnesium alloy, comprising:

said solution having phosphate and fluoride ions;

said solution containing from 1.0 g/l to less than 2.0 g/l potassium permanganate; and said solution having a pH of 5 to 7.

19. A solution according to claim 13, wherein said solution is maintained at a temperature in the range of 120 to 200 degrees Fahrenheit.

20. A solution for use in a process for forming a chromate-free, corrosion resistant coating on a product formed from magnesium or a magnesium alloy, comprising:

said solution having phosphate and fluoride ions;

said solution containing from 1.0 g/l to 5.0 g/l of an active corrosion inhibitor selected from the group consisting of potassium permanganate, sodium tungstate, sodium vanadate, and mixtures thereof;

said solution having a pH of 5 to 7; and said solution further comprising from about 0.1 to 1.0 vol % of a surfactant.

* * * * *

UNITED STATES PATENT AND TRADEMARK OFFICE

CERTIFICATE OF CORRECTION

PATENT NO. : 6,887,320 B2
DATED : May 3, 2005
INVENTOR(S) : Briles et al.

It is certified that error appears in the above-identified patent and that said Letters Patent is hereby corrected as shown below:

Title page,
Item [75], Inventors, add the omitted inventor as follows:
-- ; Xai Tang, West Hartford, CT (CN) --.

Column 5,
Line 66, "03" should read -- 0.3 --.

Column 6,
Line 14, "from" should be deleted.

Signed and Sealed this

Fifteenth Day of November, 2005

JON W. DUDAS
*Director of the United States Patent and Trademark Office*